United States Patent [19]

Szafranski

[11] Patent Number: 4,872,698

[45] Date of Patent: Oct. 10, 1989

[54] SKI BRAKE ASSOCIATED WITH A SKI BINDING

[75] Inventor: Pierre Szafranski, Annecy Le Vieux, France

[73] Assignee: Salomon, S.A., Annecy Cedex, France

[21] Appl. No.: 151,277

[22] Filed: Feb. 1, 1988

[30] Foreign Application Priority Data

Feb. 3, 1987 [FR] France ..... 87 01278

[51] Int. Cl.[4] ..... A63C 7/10

[52] U.S. Cl. ..... 280/605; 280/626

[58] Field of Search ..... 280/604, 605, 618, 633, 280/12 AB, 626, 28.11

[56] References Cited

U.S. PATENT DOCUMENTS

| | | | |
|---|---|---|---|
| 3,909,026 | 9/1975 | Salomon | 280/628 |
| 3,960,384 | 6/1976 | Salomon | 280/623 |
| 4,103,916 | 8/1978 | Krob et al. | 280/605 |
| 4,111,453 | 9/1978 | Krob | 280/626 |
| 4,138,136 | 2/1979 | Riedel | 280/605 |
| 4,139,213 | 2/1979 | Riedel | 280/605 |
| 4,277,082 | 7/1981 | Riedel | 280/605 |
| 4,279,434 | 7/1981 | Riedel | 280/605 |
| 4,288,093 | 9/1981 | Krob et al. | 280/605 |
| 4,352,507 | 10/1982 | Krob et al. | 280/605 |
| 4,500,106 | 2/1985 | Svoboda | 280/605 |

FOREIGN PATENT DOCUMENTS

| | | |
|---|---|---|
| 0355968 | 4/1980 | Austria . |
| 227939 | 7/1987 | European Pat. Off. . |
| 2635155 | 2/1978 | Fed. Rep. of Germany . |
| 2320121 | 3/1977 | France . |
| 2412324 | 7/1979 | France . |
| 2430244 | 2/1980 | France . |
| 2467611 | 4/1981 | France . |
| 2502965 | 10/1982 | France . |

*Primary Examiner*—Charles A. Marmor
*Assistant Examiner*—Tamara L. Finlay
*Attorney, Agent, or Firm*—Sandler & Greenblum

[57] ABSTRACT

An associated heel binding-ski brake assembly which comprises a binding body which is longitudinally slidable on a track to be affixed to a ski. The binding body is forwardly biased by a retraction spring; the assembly further comprises a ski brake comprising at least one projection pivotable around a horizontal substantially transverse axis. An elastic member biases the projection to the active position to activate the brake, and a control element de-activates the brake. The elastic member moves together with the binding.

24 Claims, 5 Drawing Sheets

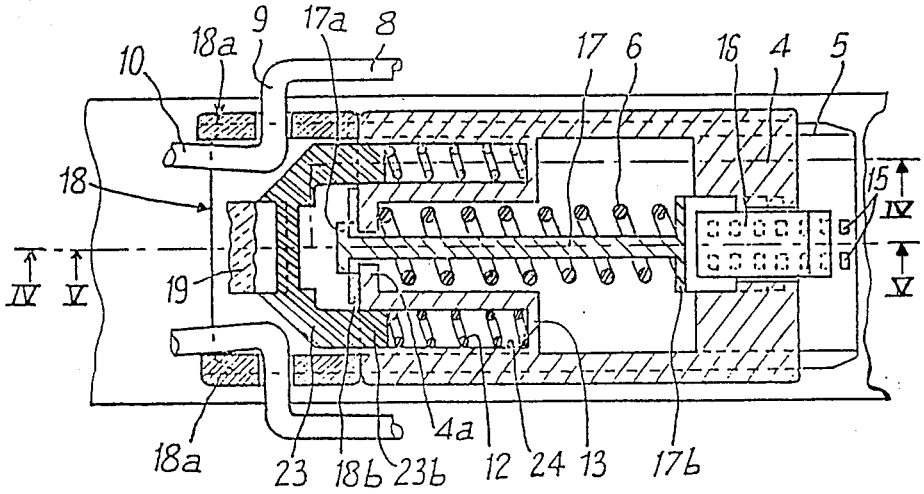
Fig. 3
Fig. 4
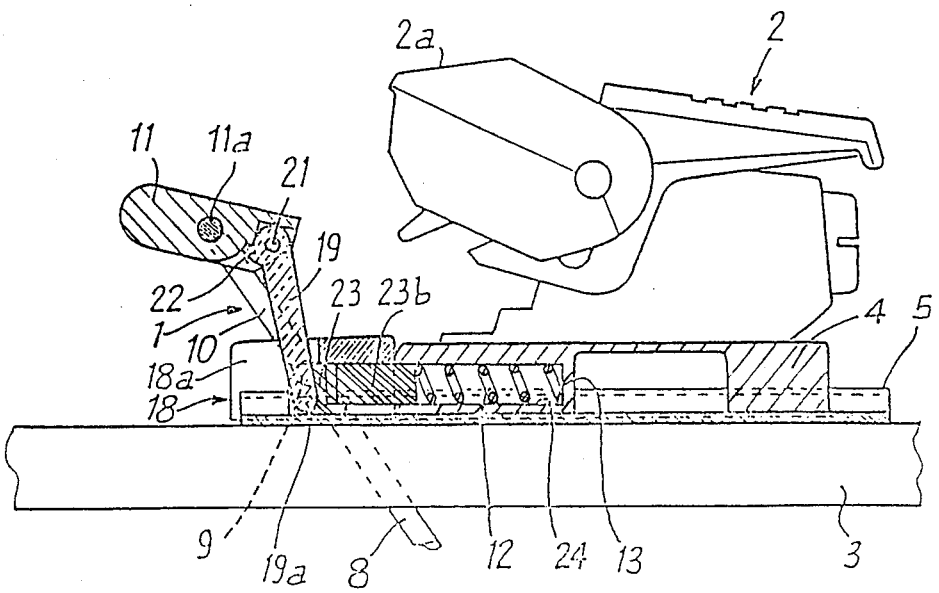

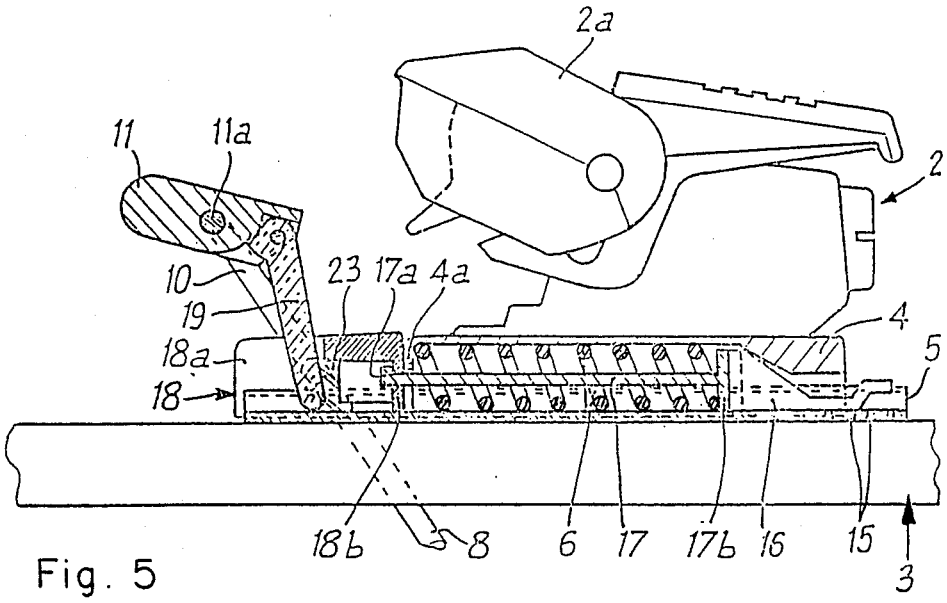
Fig. 5
Fig. 6
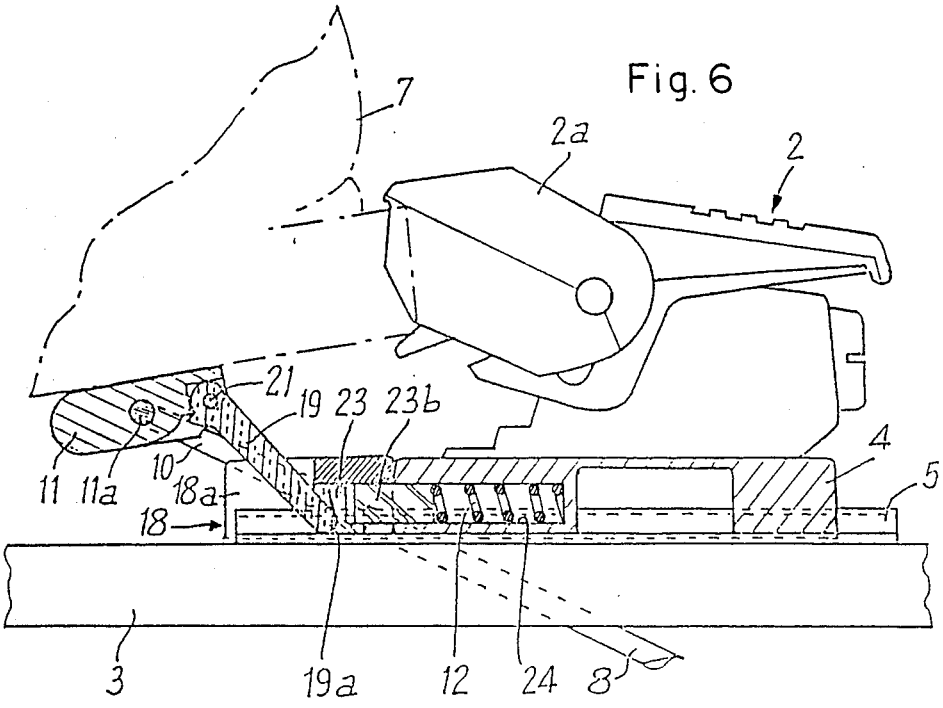

SKI BRAKE ASSOCIATED WITH A SKI BINDING

BACKGROUND OF THE INVENTION

1. Field of the Invention

The present invention relates to a ski brake associated with an alpine ski binding, more particularly a heel binding.

2. Description of Background and Relevant Information

Ski brakes are apparatus mounted on a ski which are adapted to prevent the ski from sliding down the slope when the ski is freed, as a result of the release of a safety binding during a fall. Ski brakes which are now commonly utilized in skiing generally comprise an elastically biased mechanism which comprises, on the exterior of the ski and on each side thereof, a pivoting spade or protrusion. This protrusion is adapted to engage in the snow when the ski brake is in the active braking position. Each braking protrusion is rotatably movable around an axis which is substantially transverse with respect to the ski. The ski brake furthermore comprises a control element, such as a pedal, which is activated by the boot of the skier, when inserting the boot, in a manner so as to make the protrusions pivot and to make them pass from the active braking position to an inactive position in which the protrusions are substantially lifted above the upper surface of the ski. If desired the pedal can then make the protrusions pass into a retracted position in which they are brought towards one another horizontally, in the direction of the longitudinal median plane of the ski, on both sides of the body of the heel binding, such that the ski brake leaves the skis as unencumbered as possible during skiing.

The passage of the protrusions from the active braking position to the inactive position occurs against the force of elastic return means. These return means have an energy which progressively increases from the active braking position to the inactive position. This energy is translated, to the projections, by a force or a rotational moment of the projections which tend to make them pivot downwardly, and, on the pedal, by a force or rotational moment which biases the pedal upwardly. The elastic return means most commonly utilized comprise one or more traction springs, in compression or torsion, a deformable energy buckle, etc.

In these ski brakes, the elastic return means are autonomous and independent of the rest of the safety binding itself, i.e., of the heel binding. Generally the base of the brake is affixed to the ski and the ski brake is separated from the heel binding, i.e., it does not accompany it in its longitudinal movements, during length adjustment or retraction during insertion of the boot.

The principal inconvenience of these ski brakes is that in the position where the boot is inserted, which corresponds to the inactive position of the protrusions, the control pedal which senses the presence of the boot, exerts a vertical force upwardly on the sole of the boot at the linkage between the boot and the jaw of the heel binding. This upward force becomes a parasitic force at this location because it tends to lift the jaw even at rest. It is possible to diminish the intensity of this parasitic force, for example, with an "elbow" construction, but the more that this force is diminished the less likely it is that the brake will release in the case of a fall.

Other ski brakes are known in which the elastic return means of the protrusions in the active braking position are common with the energization means of the heel binding itself. The most common construction consists of utilizing the energy of one or more return springs of the heel binding. In this respect, French patent No. 2,412,324 describes a ski brake in which the movement of the protrusions is directly linked to the movement of the heel binding, and the control element of the ski brake is the body of the heel binding itself. Furthermore, French patent No. 2,467,611 describes a ski brake in which the control pedal of the brake is mechanically connected to the body of the heel binding.

Ski brakes of these types have the advantage that when the boot is inserted there is practically no accumulated energy in the brake such that the control pedal exerts only a very weak force under the sole and there is practically no parasitic energy which is created which appears at the location of contact between the boot and the jaw of the heel binding. The ski brake according to French patent No. 2,412,324 furthermore has the advantage of not having a brake pedal. However, this construction is complex because the amplitude of the return movement of the binding is relatively small (on the order of several millimeters), and the rotational movement of the projections is by way of comparison relatively substantial (close to 90°). The transmission between these two movements is thus delicate. Another disadvantage of this ski brake is that the energy of the brake depends directly on the return energy of the binding. In other words, if one changes the return energy springs, one modifies also the energy of the brake.

These disadvantages likewise are found in the ski brake of French patent No. 2,467,611. This ski brake furthermore has the disadvantage that the movement of the heel binding and the movement of the control pedal are directly connected on the mechanical plane and yet both are separately controlled by the movement of the boot. There is thus an additional problem of synchronizing different movements with a substantial risk of floating of the heel binding or of the pedal in the position where the boot is inserted.

SUMMARY OF THE INVENTION

It is, therefore, an object of the invention to provide an associated heel binding-ski brake assembly which comprises a binding body and a ski brake. The binding body is longitudinally slidable on a slide or track to be affixed to a ski. The binding body is forwardly biased by a retraction spring. The ski brake comprises at least one projection pivotable around a horizontal substantially transverse axis. An elastic means biases the projection to the active position to activate the brake, and a control element de-activates the brake. According to the invention the elastic means moves together with the binding.

In one embodiment of the invention the elastic means is a brake spring positioned to exert a force on the brake projection, directly or indirectly, through one end thereof, and to exert a force on the body at the other end of the brake spring. Upon rearward movement of the body against the force exerted by the retraction spring the elastic means applies a reduced bias to the projection. The control element may be a pedal on which a ski boot rests when it is held by the binding. The pedal is upwardly biased by a connecting element on which the pedal is pivotably mounted. The connecting element is adapted to be pivotably mounted on the ski and to be biased by the elastic means to lift the pedal and move the projection to the active position. The brake spring is a longitudinal compression spring which presses against the body along a surface on a portion of the binding. At its other end the brake spring presses against a pusher which is longitudinally slidable relative to the body. A connecting element is pivotably mounted on a base plate and the pedal is pivotably mounted on the upper portion of the connecting element.

In a preferred embodiment the body comprises two of the brake springs, one on each side thereof positioned in logitudinal lateral chambers. The pusher is a U-shaped element having two rearwardly directed arms each extending within one of the chambers. The arms are forwardly biased by each of the brake springs. The connecting element has a curved lower end in biased contact with a curved surface on the transverse member of the pusher when the brake is in the active position. The brake is preferably formed of two projections. The binding body is mounted on a base plate which may be longitudinally affixed along a track on the ski. The base plate has two upright longitudinally extending flanges on opposite sides thereof, each of the flanges having a bore therein through which the median portion of the projection extends so as to define the transverse axis. The upper portion of the projection is secured to the pedal, whereby upward bias on the connecting element lifts the pedal to activate the brake by lowering the projection while preparing the pedal for insertion of the boot.

Ramp means may also be provided to cause the two projections to retract inwardly towards one another as the boot is inserted into the binding.

The body further comprises a transverse vertical upstanding flange having a hole in the center thereof. The body comprises an orifice in a wall in the central portion thereof, and a shaft extending through the hole and the orifice to guide the rearward movement of the body. The shaft ends in an enlarged head portion to limit the forward movement of the body. The shaft is affixed at the end opposite its enlarged head portion to an abutment affixed to the slide.

The abutment may further comprise a latch for adjustably positioning the shaft relative to the slide. Teeth on the latch are adapted for cooperation with longitudinally spaced holes in the central portion of the slide.

The retraction spring or all the retraction springs present globally has a higher spring constant than the brake springs, i.e., it is stiffer and the retraction spring and the brake springs are compressed to the same extent or to slightly different extents.

According to yet another embodiment the projection spring is a traction spring affixed to a point positioned forwardly of the rear binding, which point is associated with the rear binding to move rearwardly therewith whereby the projection spring relaxes as a result of rearward movement of the body.

BRIEF DESCRIPTION OF THE DRAWINGS

The invention will now be described by way of non-limiting example, with reference to various embodiments of the present invention illustrated in the annexed drawings in which:

FIG. 3 is a horizontal cross-sectional view of a ski brake according to the invention associated with a heel binding, the heel binding being in the released position and the ski brake being consequently in the active braking position;

FIG. 4 is a vertical and longitudinal cross-sectional view along line IV—IV of FIG. 3;

FIG. 5 is a vertical and longitudinal cross-sectional view 7 along line V—V of FIG. 3;

FIG. 6 is a vertical cross-sectional view similar to that of FIG. 4, the ski brake being shown in an intermediate position between the active braking position and the inactive position;

DESCRIPTION OF PREFERRED EMBODIMENTS

The present invention attempts to overcome the disadvantages noted above by providing a ski brake whose design is particularly simple.

To this end, the ski brake is associated with a heel binding which comprises a longitudinally sliding body on a track or slide fixed to the ski. The body is biased forwardly by a return spring called a retraction spring. The ski brake comprises at least one spade or protrusion pivoting around a substantially transverse horizontal axis, a control element of the protrusion, such as a pedal connected to the top end portion of the projection, and elastic return means biasing the protrusion in the direction of an active braking position in which it projects under the ski. The elastic return means comprise at least one brake spring coupled, at a first end, to the protrusion, directly or by means of a linkage mechanism, and is characterized in that the second end of the brake spring is coupled at a point which is affixed to the body of the heel binding and which consequently follows the longitudinal displacement of this body.

Figure 1:
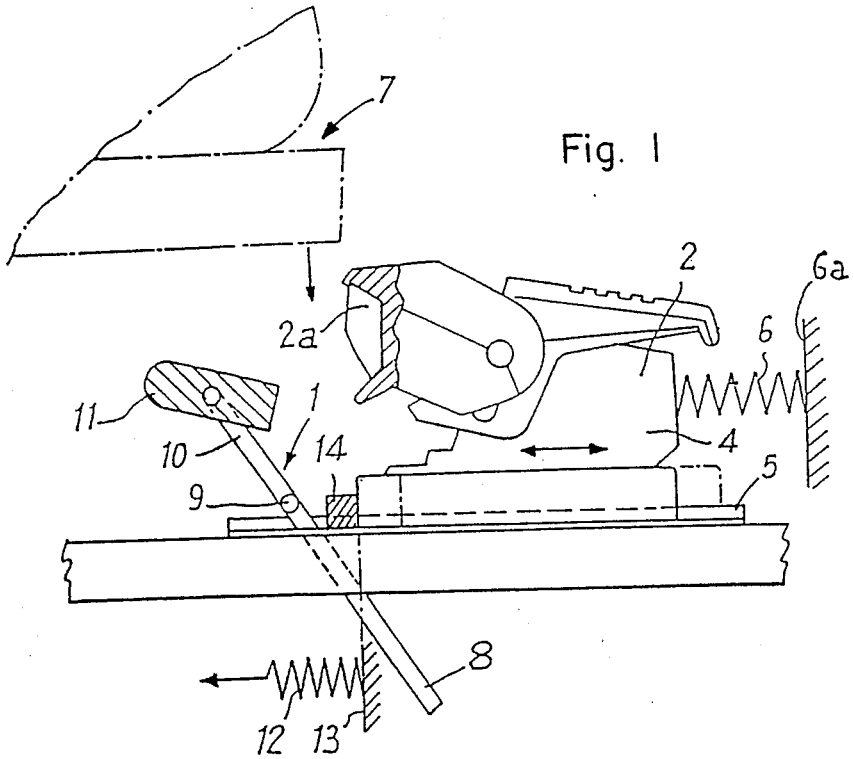
FIG. 1 is an elevational schematic view of a ski brake associated with a heel binding, the ski brake being shown in the active braking position, with the heel binding in the release position.
Figure 2:
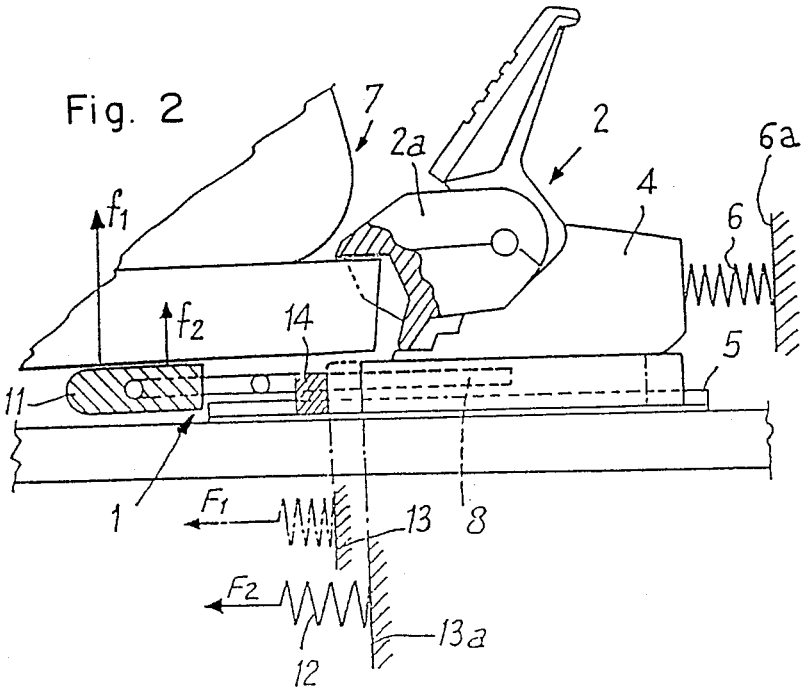
FIG. 2 is an elevational schematic view of the ski brake in the inactive position, the heel binding being in the set position.

FIGS. 1 and 2 illustrate, in a very schematic fashion, a ski brake 1 mounted, in front of a heel binding 2 and in the vicinity thereof, on a ski 3. Heel binding 2 which furthermore comprises a retention jaw, is shown only by its body 4 slidably longitudinally mounted on a slide or track 5 affixed to the ski, in a manner so as to be able to perform a return movement, against the action of a return spring 6 resting on a rear abutment 6*a*, when a boot 7 is mounted on the ski and is maintained at the rear by heel binding 2. Furthermore, ski brake 1 comprises, on both sides of the ski, a protrusion 8 which pivots around a horizontal axis 9 which is substantially transverse. Each protrusion 8 is extended, above pivot axis 9, by an upper portion or manipulation arm 10 at the end of which is journalled a pedal 11 on which the sole of boot 7 rests. In a fashion known in and of itself, ski brake 1 comprises an elastic return mechanism which is schematically shown by a spring 12 acting on each braking protrusion 8, directly or by means of a linkage mechanism. Spring 12 is constituted, in the non-limiting example shown in FIGS. 1 and 2, by a compression spring which acts, at one of its ends, in a manner so as to push each spade 8 downwardly and frontwardly, in an active braking position in which protrusion 8 is inclined from top to bottom and from front to rear.

According to the invention compression spring 12 is supported, at its end opposite to that through which it acts on protrusion 8, on a surface 13 which is a part of body 4 of the heel binding and which consequently is displaced jointly therewith towards the rear, during the retraction of the heel binding.

In the active braking position, as is shown in FIG. 1, body 4 of heel binding 2 is pushed frontwardly by spring 6 against an abutment 14. In this case support surface 13 for brake spring 12 of ski brake 1 occupies a longitudinally relatively advanced position and brake spring 12 which rests on surface 13 in the advanced position, is totally without tension, in which case it exerts no force on protrusion 8 of ski brake 1, or it is slightly prestressed and it thus exerts only a very small force on this protrusion.

When the skier puts on ski 3, boot 7 contacts jaw 2*a* of the binding which it forces to pivot downwardly until the boot is flat on the ski and the heel binding 2 is set, i.e., it maintains the rear of boot 7. This pivoting furthermore causes a retraction of body 2 of the heel binding against the retraction spring return energy 6 which is called "retraction spring". In the course of the descending movement of boot 7 it likewise comes into contact, at a predetermined moment, with pedal 11 of ski brake 1 and by pressing on this pedal 11 it makes protrusions 8 of the ski brake pivot in the counterclockwise direction. This movement serves to wind up or compress brake spring 12 which forms a part of the return mechanism of the brake. The energy accumulated by the spring and consequently the force exerted by it are a function of its compression strength. However, according to the invention, support surface 13 for spring 12 is offset towards the rear, towards a retracted position 13*a* shown in FIG. 2, because surface 13 is connected to body 4 of heel binding 2. By virtue of the retraction of support surface 13*a*, brake spring 12 is much less compressed than it would have been had support surface 13 remained fixed. To illustrate this fact, FIG. 2 illustrates the two possibilities, i.e., with a support surface 13 which is fixed and a support surface 13*a* which is retracted towards the rear. If the support surface 13 had remained fixed, brake spring 12 would be highly compressed and by virtue of the energy accumulated as a result of this high compression, it would produce a force F1 which would be relatively substantial such as indicated by the arrow in dashed lines. By virtue of the retraction of support surface 13*a*, spring 12 is only slightly compressed and it exerts a force F2 which is relatively small, a force which can even, at the limit, be zero. As a result, in the inactive position of the ski brake shown in FIG. 2, protrusion 8 of the ski brake is subjected to a very low or zero force even through pedal 11 exerts a force small f2 on the ski boot sole 7 which is directed upwardly and which is low or zero. On the contrary, if the support surface 13 had remained fixed, force F1 caused by brake spring 12 being highly compressed would result in a force fl which would be much greater being exerted on the sole, from bottom to top, thus causing an undesirable force at the location of contact between the boot and the jaw of the heel binding 2.

When the heel binding releases as a result of a fall, the return spring 6 of the heel binding pushes body 4 frontwardly and support surface 13 is put in the advanced position. This movement serves to compress spring 12 and to give back to it a sufficient energy to assure a rapid and effective pivoting of projections 8, a pivoting which brings the projections into the active braking position. In fact, the elastic return means of the ski brake recover, by virtue of the advancement of body 4 of the heel binding, all of their own energy which is necessary to assure the passage of projections 8 into the active braking position.

In addition to longitudinal retraction sliding movement as a result of insertion of the boot, the heel binding can be displaced longitudinally to provide an adjustment of the length between the front binding and the rear binding. During this movement, opposite to the previous movement, the rear abutment 6*a* of the spring is movable with the body of binding. The invention provides that for a longitudinal movement as a result of length adjustment the transverse axis 9 of the projections is movable and is displaced simultaneously with the body of the binding, more precisely the rear abutment 6*a* of the return spring.

In the embodiment of the invention shown in FIGS. 3–8 body 4 of heel binding 2 is movable along the length of track or slide 5 affixed to the ski 3. This track 5 comprises, in the rear portion of its central portion affixed to the ski, a series of holes 15 which are longitudinally spaced from one another. A latch 16 is mounted in an appropriate longitudinal position, as a function of the adjustment of the desired position for heel binding 2, itself a function of the length of boot 7, by engagement of teeth which are affixed to this latch in certain of holes 15. Latch 16 also serves as an abutment for the rear end 17*b*, in the form of an enlarged head, of a shaft 17 which extends longitudinally in body 4 and around which is wound the retraction compression spring 6 which opposes retraction of the binding.

Furthermore, ski brake 1 comprises a base plate 18 which is, itself also, adjustable longitudinally along the length of track 5. This base plate has two lateral and longitudinally extending flanges 18*a* extending vertically upwardly and in each of which is bored a bore through which passes a median portion constituting a pivot axis 9 which connects projection portion 8 itself to its upper manipulation arm portion 10. Base plate 18 likewise comprises, the length of its posterior transverse edge, a vertical transverse wing or flange 18*b* which is bored with a hole in its central portion. Through this hole passes the longitudinal shaft 17 which ends, at its front end, in an enlarged head 17*a* positioned on the front side with respect to wing 18*b* and which thus retains shaft 17 against any movement towards the rear. Retraction spring 6 of the heel binding is compressed between the posterior head 17*b* of shaft 17 and a front transverse wall 4*a* of body 4 which is bored with a central orifice for the passage of shaft 17 and which is thus pushed frontwardly by the compression spring 6 which maintains it in contact with base plate 18 of the brake. Thus, base plate 18 of the brake and of latch 16 of the heel binding are connected by shaft 17. Base plate 18 of the brake can thus be displaced with body 4 of the heel binding for the adjustment displacement of the length, and together constitute a monoblock assembly. Yet, the base plate is independent of body 4 with respect to the longitudinal return movements of body 4, i.e., the body can slide only towards the rear against the action of retraction spring 6 when heel binding 2 is set.

The ski brake comprises a connecting element 19 which connects pedal 11 to the energization means of the brake. The upper end of connecting element 19 is journalled on the rear portion of pedal 11, around a horizontal and transverse axis and this end portion has a projection 22 which limits the return movement. Pedal 11 is journalled at the upper portion of the manipulation arms 10 to the projections around a horizontal and transverse axis 11*a* positioned substantially in the middle of the pedal.

The lower end 19*a* of the connecting member 19 rests on base plate 18 and it is guided by this plate in a manner so as to be able to execute a movement in the longitudinal direction. This lower end 19*a* is in contact with a pusher 23 in the form of a U comprising a transverse front transverse member 23*a* and two arms 23*b* extending towards the rear. Each of arms 23*b* is engaged in a longitudinal seating chamber 24 provided in the lower portion of body 4, open frontwardly and closed at its rear end. The end of each of chambers 24 constitutes a support surface 13 for a compression brake spring 12 which is positioned in chamber 24 and which can be more or less compressed between the end which forms a rear support surface 13 of chamber 24 and the rear frontal surface of arm 23*b* of pusher 23.

In the active braking position shown in FIGS. 3–5 the heel binding 2 is released, its jaw 2*a* is pivoted upwardly, and body 4 is pushed into the front position, by retraction spring 6, a position in which it is applied against base plate 18 of the brake forming a front abutment for body 4. Furthermore, projections 8 and their upper manipulation arms 10 are inclined from top to bottom and front to rear, the projections 8 thus projecting under the ski. Pedal 11 is slightly inclined from top to bottom and front to rear, around its journal axis 11*a*, while connecting element 19 is slightly inclined with respect to the vertical, from top to bottom and front to rear. Pusher 23 is pushed frontwardly by return brake springs 12 which are then totally unstressed or only slightly stressed. The movement towards the front of pusher 23 is limited by the lower end 19*a*, thus forming an abutment of connecting element 19 which is blocked against pedal 11 by its projection 22.

When the skier puts his boot onto the ski he rests first, through his boot 7, on pedal 11 of brake 1, which serves to pivot projections 8 of the brake in the counterclockwise direction as is shown in FIG. 6. During this first phase of movement, lower end 19*a* of connecting element 19 is pushed towards the rear, by virtue of the initial inclination of connecting rod 19, and by moving backwardly this lower end 19*a* pushes pusher 23 which in turn is compressed, through its two arms 23*b*, against the two brake springs 12 in chambers 24. To best assure the linkage between the lower end 19*a* of connecting member 19 and pusher 23, the latter preferably has a front transverse surface which is curved and corresponds to the curvature of the lower end 19*a* of connecting element 19. However, one can envision any other linkage apparatus at this location, such as a journal having a transverse axis.

Figure 7:
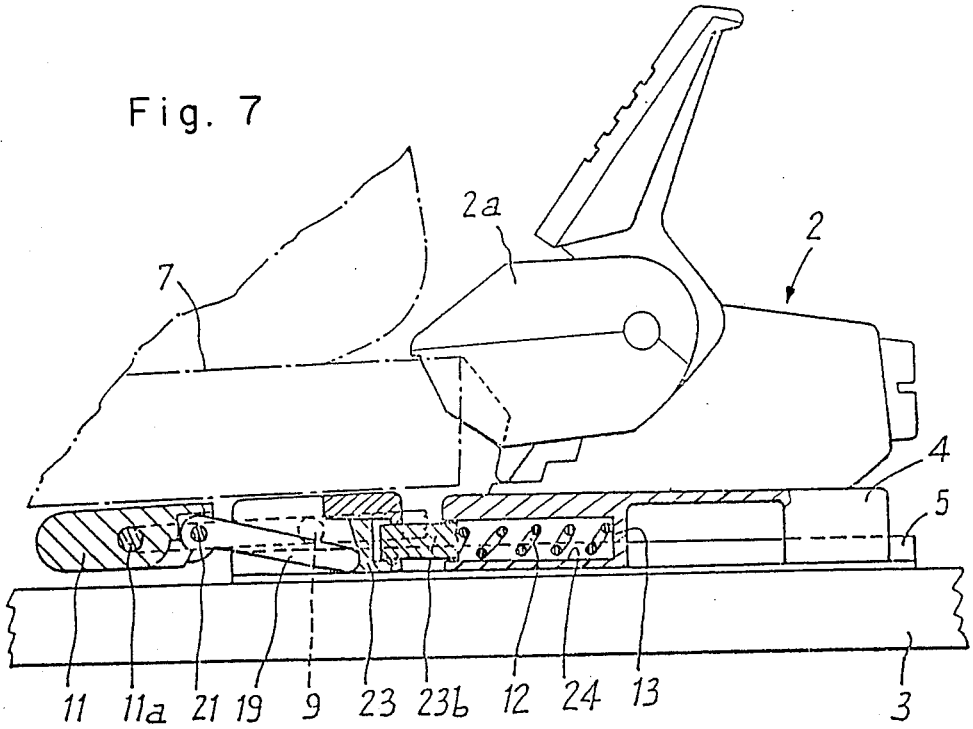
FIG. 7 is a vertical cross-sectional view similar to that of FIG. 4, the ski brake being shown in the inactive position.
Figure 8:
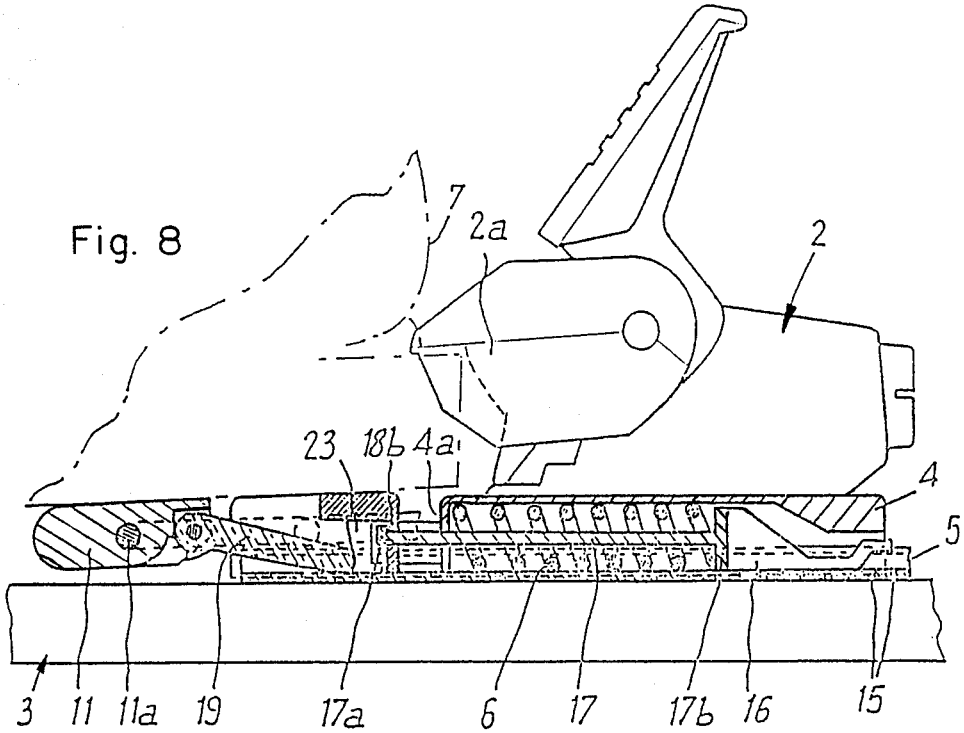
FIG. 8 is a vertical cross-sectional view similar to that of FIG. 5, the ski brake being shown in the inactive position.

During this first phase of pivoting movement of the brake, body 4 of heel binding 2 remains fixed. When boot 7 acts through its sole on jaw 2*a* of heel binding 2, by causing its pivoting which assures the activation of the binding, it simultaneously produces a return movement of body 4 of the heel towards the rear as well as its body 4 being spaced from base plate 18 as is shown in FIGS. 7 and 8. This movement occurs against a central retraction spring 6 which is increasingly compressed, as is seen in FIG. 8. This return movement of body 4 of the heel binding translates into a rearward corresponding displacement of bottom 13 of the two chambers 24 which constitute the support surfaces for brake springs 12. Otherwise stated, at the same time as springs 12 tend to further compress as a result of the progressive pressing down of arms 23*b* of pusher 23 into chambers 24, these springs become decompressed by the same value or a slightly different value by virtue of the return of support surfaces 13.

Consequently in the set position (FIGS. 7 and 8), i.e., when pedal 11 is in contact with the upper surface of ski 3 and projections 8 have been brought into a horizontal plane higher than that of this surface, brake return springs 12 are totally unstressed or only slightly stressed. As a result, pedal 11 which is positioned under the sole of the boot is not subjected to an upward force or is subjected only to a very low force, which serves to avoid any undesirable force energy at the point of contact between boot 7 and jaw 2*a* of heel binding 2.

When one of the front or rear bindings releases and boot 7 leaves the ski, retraction spring 6 of the heel binding returns towards the front body 4 as well as ends 13 of chambers 24 constituting the support surfaces for springs 12, are likewise displaced frontwardly. This causes a recompression of brake return springs 12. These springs thus have substantially all the energy necessary to make projections 8 rapidly activate as required.

It is seen, from the preceding description, that there is no interaction between the retraction spring 6 of heel binding 2 and return springs 12 of brake 1, i.e., that in reality these springs are mounted in series. For example, if one manipulates brake 1 without making body 4 of the heel binding move rearwardly, retraction spring 6 is also biased. To master this interaction it is possible to take advantage of several parameters. The first of these parameters is the rigidity of the different springs and more precisely their relative rigidities. Preferably the brake return springs 12 have a lower rigidity, otherwise stated they are more soft than retraction spring 6 of heel binding 2.

Another parameter of which one can take advantage is the extent of compression of return springs 12 of the brake with respect to that of return spring 6. These extents can be slightly different or preferably equal such that retraction of body 4 of the heel binding completely de-energizes the brake in the position where the boot is inserted. In practice these two extents are in the order of several millimeters, between 3 and 5 mm.

As was likewise previously seen, one can also act on the prestress of the springs, and in practice the return spring 6 and return springs 12 of the brake are lightly prestressed and, as mounted in the assembly, they exert a slight return force.

The descending movement of pedal 11 can occur in two steps. First, pedal 11 is lowered until its front end rests on the upper surface of ski 3. Then in the next step, the rear portion of the pedal, i.e., the one where journal axis 21 is located is lowered against ski 3, in the manner of the central journal of an elbow. This second phase is not indispensable when the brake is not retractable along the length of heel binding 2, which is the case for the embodiment illustrated in FIGS. 3–8. In the case of a nonretractable brake, the second step causes further return of end 19*a* of connecting element 19 which is preferable to store the supplemental energy in the return springs 12 themselves of the brake. This arrangement likewise makes it possible to give pedal 11 a favorable orientation in the active braking position, which facilitates the contact between the boot sole 7 and pedal 11 to pass from the active braking position to the inactive position.

Figure 9:
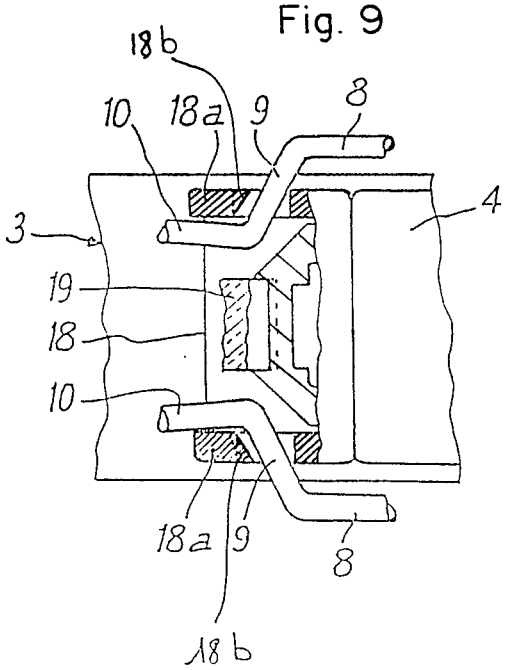
FIG. 9 is a horizontal partial cross-sectional of one embodiment of the ski brake.

If the brake is of the retractable type, as is shown partially in FIG. 9, the second step corresponds to the retraction of the brake, i.e., to the coming together of projections 8 along the length of body 4 of heel binding 2. In this case the lower end 19*a* of connecting element 19 abuts towards the rear substantially at the end of the first step in a manner such that in the second step pedal 11 pulls frontwardly by means of its journal axis 11*a* the upper end of manipulation arm 10 which in turn causes a relative coming together of projections 8 by virtue of the ramps 18*b* presented by base plate 18 of the brake at the location of the journal axes 9 of projections 8, and the inclination of journal axis 9 with respect to horizontal and transversal axis. Journal axis 9 are forwardly pulled by manipulation arms 10 to the longitudinal axis of the ski, which force axis 9 and projections 8 to come closer.

Figure 10:
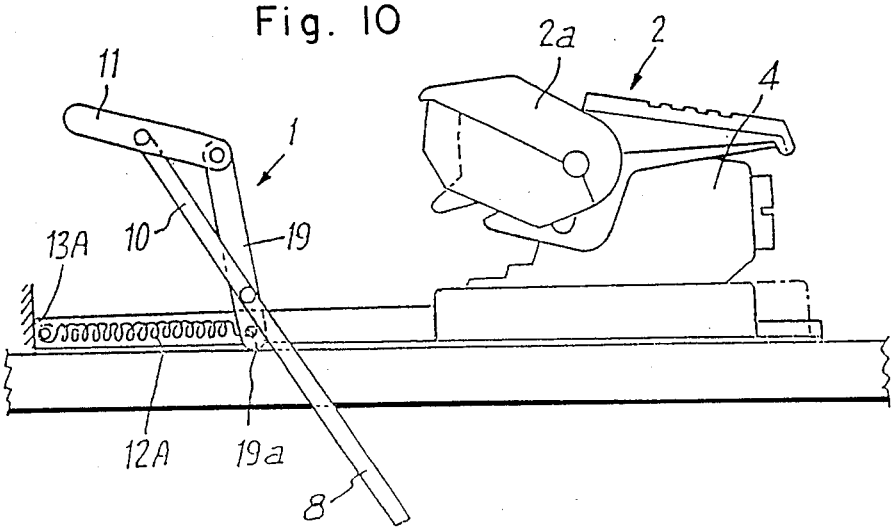
FIG. 10 is a schematic illustration of one embodiment in which the return spring of the brake is a traction spring.

While in the embodiments of the invention which have been previously described retraction spring 12 has been indicated as being a compression spring, it is self evident that the invention can be conceived using springs of another type. For example, FIG. 10 illustrates the case where retraction spring 12A of ski brake 1 is a traction spring. Spring 12A is hooked to the lower end 19*a* of connecting element 19 and it extends frontwardly until a surface 13A affixed to body 4 and to which it is hooked. The frontward tractional force exerted on lower end 19*a* of connecting rod 19 is equivalent to the frontward pressure exerted by each spring 12 in the embodiment illustrated in FIGS. 3–8. When body 4 of heel binding 2 retracts, hooking surface 13A of traction spring 12A is likewise displaced toward the rear in a manner so as to reduce or even eliminate, in the active position, the tension of spring 12A.

Although the invention has been described with reference of particular means, materials, and embodiments it is to be understood that the invention is not limited to the particulars disclosed and extends to all equivalents within the scope of the claims.

What is claimed is:

1. An associated heel binding-ski brake assembly which comprises:

(a) a binding body which is longitudinally slidable on a track to be affixed to a ski, said binding body being forwardly biased by a retraction spring; and (b) a ski brake comprising at least one projection pivotable around a substantially horizontal transverse axis between an active position and an inactive position, means for elastically biasing said at least one projection to said active position to activate said brake, and means for reducing the biasing force exerted by said elastically biasing means on said at least one projection of said ski brake in response to rearward movement of said binding body.

2. The assembly as defined by claim 1 wherein said elastically biasing means is at least one traction spring affixed to a point positioned forwardly of said heel binding, said point being associated with said heel binding to move rearwardly therewith whereby said at least one traction spring relaxes as a result of rearward movement of said binding body.

3. The assembly as defined in claim 1 wherein said elastically biasing means moves together with said binding body.

4. The assembly as defined by claim 1 wherein said elastically biasing means comprises at least one brake spring positioned to exert a force on said at least one brake projection, directly or indirectly, through one-end thereof, and to exert a force on the binding body at the other end of said at least one brake spring.

5. The assembly as defined by claim 4 wherein said brake spring is a longitudinal compression spring which presses against said body along a surface on a portion of said binding.

6. The assembly as defined by claim 5 wherein said brake spring presses against a pusher which is longitudinally slidable relative to said body, said pusher being adapted to bias a connecting element mounted on a base plate adapted to be affixed to said ski.

7. The assembly as defined by claim 6 wherein said pedal is pivotably mounted on the upper portion of said connecting element.

8. The assembly as defined by claim 7 wherein said elastically biasing means comprises two of said brake springs, one on each side thereof positioned in longitudinal lateral chambers in said body, and wherein said pusher is a U-shaped element having two rearwardly directed arms each extending within one of said chambers, said arms being forwardly biased by each of said brake springs.

9. The assembly as defined by claim 8 wherein said connecting element has a curved lower end in biased contact with a curved surface on a transverse member of the pusher.

10. The assembly as defined by claim 9 comprising two of said projections and further comprising a binding base plate which may be longitudinally affixed along a track on said ski, said binding base plate having two upright longitudinally extending flanges on opposite sides thereof, each of said flanges having a bore therein through which the median portion of each of said projections extends so as to define said transverse axis.

11. The assembly as defined by claim 10 further comprising ramp means for causing said two projections to move inwardly towards one another as said boot is inserted into said binding.

12. The assembly as defined by claim 10 wherein the upper portion of said projection is journalled to said pedal, whereby upward bias on said connecting element lifts said pedal to activate said brake by lowering said projection while preparing said pedal for insertion of the boot.

13. The assembly as defined by claim 12 wherein said binding body further comprises a transverse vertical upstanding flange having a hole substantially in the longitudinal center thereof, and wherein said binding body comprises an orifice in a wall substantially in a longitudinal central portion of said binding body, and a shaft extending through said hole and said orifice to guide the rearward movement of said binding body.

14. The assembly as defined by claim 13 wherein said shaft ends in an enlarged head portion to limit the forward movement of said body.

15. The assembly as defined by claim 14 wherein said shaft is affixed at the end opposite its enlarged head portion to an abutment affixed to said track.

16. The assembly as defined by claim 15 wherein said slide has a central portion, said abutment comprises a latch for adjustably positioning said shaft relative to said slide, said latch comprising means adapted for cooperation with longitudinally spaced holes in said central portion of said slide.

17. The assembly as defined by claim 16 wherein said retraction spring has a higher spring constant than said brake springs.

18. The assembly as defined by claim 17 wherein said retraction spring and said brake springs are compressed to the same extent.

19. The assembly as defined by claim 17 wherein said retraction spring and said brake springs are compressed to slightly different extents.

20. The assembly as defined by claim 1 further comprising a control element functionally connected to said at least one projection for moving said at least one projection to said inactive position.

21. The assembly as defined by claim 20 wherein said control element is a pedal on which a ski boot rests when it is held by said binding.

22. The assembly as defined by claim 21 wherein said pedal is upwardly biased by a connecting element on which said pedal is pivotably mounted, said connecting element to be pivotably mounted relative to said ski and biased by said elastically biasing means to lift said pedal and move said at least one projection to said active position.

23. An associated heel binding-ski brake assembly which comprises:

(a) a binding body which is longitudinally slidable on a track to be affixed to a ski, said binding body being forwardly biased by at least one retraction spring;

(b) a ski brake comprising at least one projection pivotable around a substantially horizontal transverse axis, means for elastically biasing said at least one projection to an active position to activate said brake, a control element functionally associated with said at least one projection for moving said at least one projection to an inactive position for deactivating said brake, and means for reducing the bias on said at least one projection in said inactive position of said at least one projection in response to rearward movement of said binding body.

24. An associated heel binding-ski brake assembly which comprises:

(a) a binding body which is longitudinally slidable on a track to be affixed to a ski, said binding body being forwardly biased by a retraction spring, said binding body being mounted relative to said track to be moved rearwardly during insertion of a boot into the binding; and (b) a ski brake comprising at least one projection pivotable around a substantially horizontal transverse axis, an elastic means for biasing said at least one projection to an active position to activate said brake, said elastic means being movable together with said binding body and mounted in series with said retraction spring whereby rearward movement of said binding body during insertion of said boot results in a reduction of the bias on said at least one projection.

* * * * *

UNITED STATES PATENT AND TRADEMARK OFFICE

CERTIFICATE OF CORRECTION

PATENT NO. : 4,872,698

DATED : OCTOBER 10, 1989

INVENTOR(S) : Pierre SZAFRANSKI

It is certified that error appears in the above-identified patent and that said Letters Patent is hereby corrected as shown below:

column 5, line 28, change "2" to —4—;
column 5,line 61, change "through" to —though—;
column 8, line 23, delete "energy" after "force";
column 9, line 22, change "axis" to —axes—;
column 9,line 23, change "axis" to —axes— (both occurrences); and
column 9,line 25, change "axis" to —axes—.

Signed and Sealed this

Twenty-second Day of October, 1991

*Attest:*

HARRY F. MANBECK, JR.

*Attesting Officer*

*Commissioner of Patents and Trademarks*